United States Patent [19]

Feldstein

[11] 3,982,054

[45] Sept. 21, 1976

[54] METHOD FOR ELECTROLESSLY DEPOSITING METALS USING IMPROVED SENSITIZER COMPOSITION

[75] Inventor: Nathan Feldstein, Kendall Park, N.J.

[73] Assignee: RCA Corporation, New York, N.Y.

[22] Filed: Mar. 25, 1974

[21] Appl. No.: 454,155

Related U.S. Application Data

[63] Continuation-in-part of Ser. No. 226,294, Feb. 14, 1972, abandoned.

[52] U.S. Cl. ..... 427/299; 106/1; 427/304; 427/306; 427/305

[51] Int. Cl.[2] ..... C23C 3/02

[58] Field of Search ..... 117/47 A, 130 E; 106/1; 427/304, 305, 306, 299

[56] References Cited

UNITED STATES PATENTS

| | | | |
|---|---|---|---|
| 3,379,556 | 4/1968 | Chiecchi | 117/47 A |
| 3,573,973 | 4/1971 | Drotar et al. | 117/47 A |
| 3,616,296 | 10/1971 | Bernhardt et al. | 117/47 A |
| 3,666,527 | 5/1972 | Feldstein et al. | 117/47 A |
| 3,698,939 | 10/1972 | Leaman | 117/47 A X |
| 3,764,488 | 10/1973 | Bernhardt et al. | 117/47 A X |
| 3,793,072 | 2/1974 | Lando | 117/47 A X |
| 3,904,792 | 9/1975 | Gulla et al. | 427/304 |

*Primary Examiner*—Ralph S. Kendall
*Assistant Examiner*—John D. Smith
*Attorney, Agent, or Firm*—Glenn H. Bruestle; Arthur E. Wilfond; William S. Hill

[57] ABSTRACT

Method for autocatalytically plating a dielectric surface with a metal such as nickel, cobalt or copper comprising sensitizing the surface with a sensitizing solution comprising both divalent tin, tetravalent tin and a substance furnishing either additional chloride ion (that is, in addition to what may be present in the sensitizer compounds) or bromide ion. The method also includes treating the sensitized surface with a catalyzing solution to provide catalytic nucleating centers and plating the metal on the catalyzed surface.

7 Claims, No Drawings

METHOD FOR ELECTROLESSLY DEPOSITING METALS USING IMPROVED SENSITIZER COMPOSITION

This application is a Continuation-in-Part of Application Ser. No. 226,294 filed February 14, 1972 now abandoned.

BACKGROUND OF THE INVENTION

Certain metals can be plated on non-metallic surfaces by an autocatalytic plating process in which the surface is first treated with a sensitizing solution, then with an activating solution which precipitates nucleating sites. In this way, ceramics and many synthetic resins can be provided with coatings of nickel or copper, for example, which may or may not be later covered with a heavier layer of metal by electroplating.

The sensitizing solution most commonly used in the past contains $Sn^{+2}$ ions generally formed from the salt stannous chloride dissolved in hydrochloric acid. This material has proved to be quite satisfactory for electroless plating of metals on most non-metallic materials. However, there are certain materials, such as Teflon and silicone rubbers, as well as certain commercial photoresists, which cannot be satisfactorily plated by this method. The reason for the difficulty appears to be that these materials are unusually smooth and non-porous and are not readily wetted by aqueous solutions of stannous salts. As a result, when one attempts to deposit metal autocatalytically on one of these materials with no surface roughening, using conventional stannous salt sensitizers and conventional activators, such as palladium chloride, plating is spotty and otherwise non-uniform.

It should be noted that, in general, those who have used acidic solutions of stannous salts as electroless plating sensitizers, have tried to keep the tin ion in the divalent state by methods such as keeping metallic tin or other reducing agents, such as sugars, in the shelf stock solutions.

In addition to electroless plating, there are many other processes in which it is desired to convert hydrophobic surfaces to hydrophilic surfaces. For example, in painting with a water base paint, it may first be necessary to convert the surface to be painted from hydrophobic to hydrophilic. There is a need for simple and inexpensive ways to accomplish the conversion.

DESCRIPTION OF PREFERRED EMBODIMENTS

It has been found that if stannic ion and either additional chloride ion or bromide ion are added to conventional acid sensitizing solutions containing stannous ion, and the resulting solution is used to treat difficult-to-plate non-metallic surfaces, in the usual way, these sensitized surfaces (after the usual activation treatment) can readily be given uniform metal coatings by conventional autocatalytic electroless plating solutions.

The improved method is applicable to the deposition of any metal that has previously been deposited autocatalytically. These metals include nickel, cobalt, copper, platinum, gold and palladium and combinations of these.

It has also been found that addition of certain chlorides or bromides to conventional acid sensitizing solutions containing only stannous chloride and hydrochloric acid, improves the stability of these solutions.

In order to show comparisons between use of sensitizing solutions containing, effectively, only stannous and stannic ion, or either one of these alone, with solutions containing added controlled amounts of chloride ion or bromide ion, some experimental examples are given below.

Examples 1 and 2 demonstrate the improved stability obtained, as measured by the time required before a precipitate appears in the solution. Examples 3 to 6 demonstrate improvement in wetting.

EXAMPLE 1

In this example, sensitizing solutions were made and observed for the necessary time to yield precipitation.

| Solution | Approximate Days for Precipitation (Room temperature of about 23°C) |
|---|---|
| 1. 0.13M $SnCl_2$, 0.47M HCl and $6.5 \times 10^{-3}$M $SnCl_4$* | 20 |
| 2. Same as No. 1 plus 2.0M NaCl | 72 |

*$SnCl_4$ was added from 0.5M stock solution which was prior aged for about 1 week at room temperature. When stannic chloride, or other stannic salt, solution is permitted to age for a period of time, the tin salt polymerizes. When this aged solution is added to a conventional sensitizer solution composed of stannous chloride and hydrochloric acid, the wetting properties of the solution are improved over a solution containing only stannous chloride and hydrochloric acid or one containing stannous chloride, hydrochloric acid and a stannic salt that has not been aged. The ranges of concentration of the aged stannic salt solution is preferably from about 0.1M to 1.4M before adding it to the rest of the bath.

It has been found that less time is required to significantly age a dilute stannic salt solution than a more concentrated solution. Thus, the contact angle of a solution consisting of 0.47 molar HCl and 0.13M $SnCl_2$ on AZ 1350 photoresist was reduced from about 68° to about 38° using $7.5 \times 10^{-3}$ molar stannic chloride that had been aged only 3 days as a 0.1 molar solution. When aged as a 0.5 molar solution the contact angle had not been reduced to this extent after one week of aging. Raising the temperature of the stannic salt solution also reduces the time required to age it to a particular degree.

The present invention is applicable to solutions containing all combinations of stannous and stannic ions described in application Ser. No. 60,091 of Nathan Feldstein and Thomas S. Lancsek, filed July 31, 1970 now U.S. Pat. No. 3,666,527 and assigned to RCA Corporation.

EXAMPLE 2

This test was made under accelerated conditions of heating (45° C).

| | Solution | Approximate Days For Precipitation |
|---|---|---|
| 1. | 0.13M $SnCl_2$, 0.47M HCl and $6.5 \times 10^{-3}$M $SnCl_4$* | 2 to 3 |
| 2. | Same as No. 1 plus tin shot | 5 to 6 |
| 3. | Same as No. 1 plus 1.0M NaCl | 9 |

*$SnCl_4$ was added from 0.5M stock solution which was prior aged for about 1 week at room temperature.

Although in the above two examples the chloride ion was used (via sodium chloride), a similar increase in stability was observed with the addition of sodium bromide.

In the following set of examples, it will be demonstrated that the incorporation of a chloride or a bromide i.e. sodium chloride or sodium bromide in a sensitizing solution, improves the wetting properties of the solution. It was also found that a correlation between the contact angle and uniformity of the metal layer exists when the substrate is subsequently plated electrolessly. Specifically, as the contact angle is lowered, the uniformity of metallic coverage is increased. Hence, contact angle measurements are submitted since they are more sensitive and can be measured quantitatively. The procedure used for the contact angle measurements is as follows:

1. Immersion of substrate into various sensitizer compositions for 1.0 minute.
2. Substrates were dipped (about 2 sec) in deionized water of 1 liter volume.
3. Substrates were rinsed in deionized water in an overflow rinse tank (volume = 1.2l) with a flow rate about 4 liters/minute.
4. Substrates were spin dried in air.
5. Drops of deionized water (or palladium chloride solution consisting of 1 g/l$PdCl_2$ and 1 cc/l concentrated HCl) were placed on the substrate using a Pasteur pipette from a controlled height of 0.184 inch.
6. Contact angle measurements of the water drops, were made using a contact angle goniometer model A-100 (Rame-Hart, Inc.).

EXAMPLE 3

In this example, a commercial photoresist, KTFR, was used as the substrate of interest. The experiments were conducted at room temperature.

| | Molar conc. of added $SnCl_4$* | Molar conc. of $SnCl_2$ and HCl respectively | Molar conc. of added NaCl | Contact Angle, Degrees |
|---|---|---|---|---|
| 1 | | none | none | 64 |
| 2 | | 0.065 ; 0.23 | none | 42 |
| 3 | $1.25 \times 10^{-2}$ | 0.26 ; 0.93 | none | 15 |
| 4 | | 0.065 ; 0.23 | 4 | 15 |
| 5 | | none | 4 | 33 |

*The $SnCl_4$ used was from a stock solution of 0.5 Molar which was aged for at least one week at room temperature prior to its use.

The results of Example 3 demonstrate that when sodium chloride is added to the treating solution there is a significant lowering of the contact angle of the later deposited water drop, and, of course, improved wetting of the substrate. This is true when the $SnCl_4$ solution is used alone or in combination with $SnCl_2$ and HCl.

Although the above Example also indicates that a lowering of the contact angle can also be obtained by increasing the concentration of the $SnCl_2$ without adding NaCl, $SnCl_2$ is much more expensive than NaCl. Also the added NaCl imparts improved stability to the solution.

EXAMPLE 4

In this example a positive commercial resist (AZ-1350) was used as the substrate. AZ-1350 is a commercial positive acting photoresist marketed by the Shipley Co. The experiments were conducted at room temperature.

| | Molar Conc. of $SnCl_4$* | Molar Conc. of added NaCl | Contact Angle Degrees |
|---|---|---|---|
| 1 | | 0 | 61 |
| 2 | $6.5 \times 10^{-3}$ | 1 | 60 |
| 3 | | 2 | 42 |
| 4 | | 4 | 41 |
| 5 | | 6 | 35 |

*The $SnCl_4$ used was from a stock solution of 0.5 Molar which was aged for at least one week at room temperature prior to use.

As seen from the above results, the addition of sodium chloride lowers significantly the resulting contact angle when aged $SnCl_4$ is used alone. Thus, stannic chloride to which additional chloride ion has been added, can be used to convert normally hydrophobic surfaces to hydrophilic surfaces.

EXAMPLE 5

The substrate used was the same as in Example 4; however, 0.13M $SnCl_2$ and 0.47M HCl were present in all cases. The stannic chloride is the same as in Example 4. The experiments were conducted at room temperature.

| | Molar Conc. of added NaCl | Contact Angle Degrees |
|---|---|---|
| 1 | 0 | 58 |
| 2 | 0.5 | 45 |
| 3 | 0.75 | 35 |
| 4 | 3.3 | 24 |
| 5 | 6.0 | 19 |

Here, too, the addition of sodium chloride results in a significant lowering of the contact angle; i.e. results in improved uniformity of plating.

EXAMPLE 6

The following Example involves use of Teflon plastic as a substrate. Teflon is usually one of the most difficult surfaces to wet and to plate electrolessly. The Example shows a comparison between the wetting properties of a solution containing only stannous chloride and hydrochloric acid, a solution containing both stannous and stannic chlorides but no added chloride ion, and a solution containing sodium chloride in addition to stannous and stannic chlorides. The effect of added sodium chloride on a solution containing only stannic chloride is also shown.

Contact Angle of Water on Teflon vs. Sensitizer Composition At Room Temperature

| | $[Sn^{+2}]$ Molar | $[Sn^{+4}]$* Molar | [HCl] Molar | [NaCl] Molar | Contact Angle |
|---|---|---|---|---|---|
| 1 | 0 | 0 | 0 | 0 | 104° |

-continued

Contact Angle of Water on Teflon vs. Sensitizer Composition At Room Temperature

| | $[Sn^{+2}]$ Molar | $[Sn^{+4}]$* Molar | [HCl] Molar | [NaCl] Molar | Contact Angle |
|---|---|---|---|---|---|
| 2 | 0.13 | 0 | 0.48 | 0 | 98° |
| 3 | 0 | $7.5 \times 10^{-3}$ | 0 | 3 | ≈30° |
| 4 | 0.13 | $7.5 \times 10^{-3}$ | 0.48 | 0 | 34° |
| 5 | 0.13 | $7.5 \times 10^{-3}$ | 0.48 | 3 | 15° |
| 6 | 0 | $7.5 \times 10^{-3}$ | 0 | | 104° |

*0.50M $SnCl_4$ aged for at least one week at room temperature.

Example 7 below shows the marked improvement in wettability on a particular photoresist of a solution containing both stannous and stannic chlorides when sodium bromide is added to the solution.

EXAMPLE 7

Effect of Sodium Bromide on the Wetting Ability of Sensitizer At Room Temperature

| Sensitizer | Contact Angle on AZ-1350 Resist |
|---|---|
| 0.48M HCl + 0.13M $SnCl_2$ + $7.5 \times 10^{-3}$M $Sn^{+4}$* | 55° (±20 |
| As above + 4M NaBr | 12° (±5) |

*Prepared from 0.50M stock solution of $SnCl_4$ aged at least 1 week at room temperature.

EXAMPLE 8

Another experiment was performed to compare the stability of a conventional sensitizer solution containing only $SnCl_2$ and HCl with one containing added NaCl.

The control solution consisted of $SnCl_2$ – 0.13M and HCl – 0.47M. When maintained at 45° C, some precipitate was observed after 15 minutes.

Another solution was made up as above and saturated with NaCl. When this solution was kept at 45° C the solution was still clear and operative after 24 hours.

Added chloride or bromide ion also improves the stability of sensitizing solutions made up by adding powdered $SnCl_4.5H_2O$ to conventional sensitizer solutions containing $SnCl_2$ and HCl. An example of such a bath is one containing $6.4 \times 10^{-2}$ M $SnCl_2$, 0.19 M HCl and $2 \times 10^{-2}$ M $SnCl_4$. To this bath, amounts of sodium chloride or sodium bromide in a concentration of 0.5M to saturation, are added.

The same improvement in stability of the bath occurs if the chloride or bromide is included in sensitizer solutions made by combining $SnCl_2$ and $SnCl_4$ and permitting the bath to age for about 2 weeks prior to use.

Iodide ion has also been found to improve the wetting properties of solutions of aged stannic chloride on surfaces which are difficult to wet as shown by the following example.

EXAMPLE 9

In this example, as in the previous examples, the $SnCl_4$ solution was 0.5 molar and aged for at least 1 week at room temperature prior to use.

First, a $2.5 \times 10^{-2}$ molar solution of the aged $SnCl_4$ was applied to the surface or plate coated with AZ-1350 photoresist. No wetting occurred. For comparison, a similar solution of aged $SnCl_4$ was used containing sodium iodide in 3 molar concentration. This solution wet the AZ-1350 surface very well. The range of iodide concentration can be between about 0.5 molar and saturation. Other soluble iodides can be used.

Added chloride, bromide or iodide ion, singly or in combination can be used to improve the wetting properties of aged $SnCl_4$ solution which is then used by treating a surface to be electrolessly plated, prior to treating it with a sensitizer solution containing stannous chloride and hydrochloric acid. In all cases where only stannic ion solutions are used (no stannous ion present), the aged stannic ion can be present in a concentration range from about 0.001 molar to about 1.6 molar. This is the case regardless of whether the stannic ion solution is used for treating a surface to be electrolessly plated or some other use where improved wetting properties are desired.

EXAMPLE 10

In addition to NaCl and NaBr, a number of other chlorides and bromides have been found to exert a stabilizing effect on sensitizing solutions as shown in the table below.

The basic sensitizer solution was made up of:

| | |
|---|---|
| $SnCl_2.2H_2O$ | 0.125 molar |
| HCl | 0.475 molar |
| $SnCl_4$ (aged 1 week as a separate 0.5 molar stock solution) | $6.5 \times 10^{-3}$ molar |

To this was added the salts listed below so that the concentration of the salt in the solution was 0.5 molar.

| Salt | Time to Become Cloudy (Hours) | Time to Form Noticeable Precipitate (Hours) |
|---|---|---|
| none | <23 | <23 |
| $CdCl_2$ | 23 | 27 |
| $NH_4Br$ | 23 | 27 |
| $CaCl_2$ | 70 | 75 |
| $MgCl_2$ | 62 | 70 |
| KCl | 62 | 70 |
| $NH_4Cl$ | 75 | 94 |

Any of the above salts can be present in an amount up to saturation.

EXAMPLE 11

The effect of certain bromides on the wetting properties imparted to a surface by a conventional sensitizer solution is shown in the table below. The basic sensitizer solution was composed of:

| | |
|---|---|
| $SnCl_2$ | 0.125 M |
| HCl | 0.475 M |
| $SnCl_4$ (prepared from 0.50 M $SnCl_4$ solution aged more than one week) | $6.5 \times 10^{-3}$ M |

The sensitizer solution, with added bromide, was used to treat glass plates coated with Shipley AZ-1350 photoresist. The plates were dried and the contact angle of a drop of water placed in the sensitized surface was measured with the results shown below.

| Salt-Concentration | Contact Angle |
|---|---|
| NaBr - 1 M | 16° ± 3° |
| KBr - 1 M | 18° ± 3° |
| LiBr - 1 M | 16° ± 3° |
| $NH_4Br$ - 1 M | 14° ± 3° |
| $ZrBr_2$ - 0.5 M | 16° ± 3° |
| $MgBr_2$ - 0.5 M | 21° ± 3° |
| $BaBr_2$ - 0.5 M | 17° ± 3° |
| $CaBr_2$ - 0.5 M | 15° ± 3° |

Any soluble bromide can be used to improve the wetting properties imparted to a hydrophobic surface by a stannous chloride sensitizing solution.

EXAMPLE 12

The effect on the wetting properties imparted to a hydrophobic surface by conventional stannous chloride sensitizing solution by adding chlorides other than NaCl, was tested by adding various chlorides as shown in the table below. In each case a Teflon surface was treated with the sensitizer solution for 1 minute at 20° C, then rinsing and spin-drying. The basic sensitizing solution (without the added chloride) consisted of: 0.125 M $SnCl_2$, 0.45 M HCl and $6.5 \times 10^{-3}$ M $SnCl_4$ that had been separately aged for at least 1 week as a 0.5 M solution. Each of the chloride salts was added so that it had a concentration of 0.5 M in the sensitizer solution.

After the sensitized surface was dried, a drop of water was placed on the sensitized surface and the contact angle measured.

| Salt Added | Contact Angle |
|---|---|
| None | 35° ± 3° |
| $AlCl_3$ | 29° ± 3° |
| $CrCl_3$ | 20° ± 3° |
| LiCl | 18° ± 3° |
| $CdCl_2$ | 18° ± 3° |
| $CaCl_2$ | 14° ± 3° |
| $MgCl_2$ | 15° ± 3° |
| KCl | 14° ± 3° |
| $NH_4Cl$ | 15° ± 3° |

From these results it was concluded that any soluble chloride could be used.

Combinations of bromides and chlorides in any ratio, are also effective.

It has also been found that, in general, the added chlorides, bromides, or iodides, singly or in combination, have the same effect on the wetting properties imparted to a surface by solutions of aged tetravalent tin ion as have chlorides or bromides on solutions containing both divalent tin ion and aged tetravalent tin ion.

I claim:

1. A method for electrolessly plating a surface with a metal comprising the steps of:

sensitizing the surface with a solution made by mixing separate sources of divalent tin ion and tetravalent tin ion in a molar ratio of 1:1 to about 1000:1, where said divalent tin ion is present in a concentration of up to about 0.26 molar, said tetravalent tin ion is present in a concentration of up to about 0.125 molar, and has been aged for a period equivalent to at least 1 week at room temperature and also containing either an added soluble chloride salt or an added soluble bromide salt, or both, said salts being present in a concentration, in the ionized state, between about 0.5 M and saturation, treating the sensitized surface with a catalyzing solution to provide catalytic nucleating sites thereon, and electrolessly plating said metal on said catalyzed surface.

2. A method according to claim 1 in which the added tetravalent tin ion is in a solution which was aged for at least about 1 week before combining it with a source of divalent tin ion.

3. A method according to claim 1 in which said surface is a dielectric surface.

4. A method for rendering a hydrophobic surface more hydrophilic comprising:

treating the surface with an aged solution consisting of a stannic compound in a concentration of about 0.001 M to about 1.6 M and an added soluble chloride salt, bromide salt, or iodide salt, singly or in combination, in a concentration, in the ionized state, between about 0.5 M and saturation.

5. A method according to claim 4 in which said surface is a dielectric.

6. A composition for sensitizing a substrate for electroless plating consisting essentially of:

an aqueous solution containing divalent tin ion and separately aged tetravalent tin ion in a molar ratio of from 1:1 to about 1000:1 and an additional chloride salt or bromide salt, or both, in a concentration, in the ionized state, of between about 0.5 M and saturation.

7. A composition consisting essentially of an aqueous solution of aged tetravalent tin ion having a concentration from about 0.001 molar to about 1.6 molar and an additional chloride, bromide or iodide salt, singly or in combination, in a concentration range, in the ionized state, between about 0.5 molar and saturation.

* * * * *